US009920594B2

(12) United States Patent
Chalifoux et al.

(10) Patent No.: US 9,920,594 B2
(45) Date of Patent: Mar. 20, 2018

(54) METHOD AND APPARATUS FOR SUPPORTING CABLES WITHIN COIL TUBING

(71) Applicant: Petrospec Engineering Ltd., Sherwood Park (CA)

(72) Inventors: Gerald Chalifoux, Sherwood Park (CA); Scott Penny, Sherwood Park (CA); Clint Jones, Sherwood Park (CA)

(73) Assignee: Petrospec Engineering Ltd., Sherwood Park (CA)

( * ) Notice: Subject to any disclaimer, the term of this patent is extended or adjusted under 35 U.S.C. 154(b) by 626 days.

(21) Appl. No.: 14/273,372

(22) Filed: May 8, 2014

(65) Prior Publication Data

US 2015/0300126 A1 Oct. 22, 2015

(30) Foreign Application Priority Data

Apr. 17, 2014 (CA) ..... 2849132

(51) Int. Cl.
*E21B 17/20* (2006.01)
*E21B 36/00* (2006.01)
*E21B 36/04* (2006.01)

(52) U.S. Cl.
CPC ..... *E21B 36/006* (2013.01); *E21B 17/206* (2013.01); *E21B 36/04* (2013.01)

(58) Field of Classification Search
CPC ..... E21B 17/206; E21B 36/04; E21B 36/006; E21B 17/20
See application file for complete search history.

(56) References Cited

U.S. PATENT DOCUMENTS 2,748,358 A * 5/1956 Johnston ..... E21B 17/028 166/65.1
3,835,929 A * 9/1974 Suman, Jr. ..... E21B 17/1035 166/384
4,098,476 A 7/1978 Jutte et al.
(Continued)

FOREIGN PATENT DOCUMENTS

EP 0 893 573 A2 1/1999
EP 0 882 868 B1 6/2002
(Continued)

*Primary Examiner* — David L Andrews
*Assistant Examiner* — Ronald R Runyan
(74) *Attorney, Agent, or Firm* — Christensen O'Connor Johnson Kindness PLLC

(57) ABSTRACT

A method of hanging a cable within a coiled tubing string includes the steps of determining a length of coiled tubing required within a well having a wellhead; determining a length of a cable required within the coiled tubing, the cable having a structural component along the length of the cable sufficient to support the weight of the cable; cutting the tubing string and installing a hanger sub in the coiled tubing string toward, the wellhead attachment section relative to the downhole end, the hanger sub comprising an inner shoulder that extends radially into the hanger sub and defines an opening; and attaching an outer shoulder to the cable and inserting the cable into the coiled tubing string until the outer shoulder of the cable engages the inner shoulder of the hanger sub such that the inner shoulder positions the cable below the outer shoulder.

15 Claims, 5 Drawing Sheets

(56) References Cited

U.S. PATENT DOCUMENTS

| | | | | |
|---|---|---|---|---|
| 4,346,256 | A | 8/1982 | Hubbard et al. | |
| 4,749,341 | A * | 6/1988 | Bayh, III | E21B 17/003 166/214 |
| 5,191,173 | A | 3/1993 | Sizer et al. | |
| 5,193,614 | A | 3/1993 | Cox | |
| 5,269,377 | A | 12/1993 | Martin | |
| 5,400,430 | A * | 3/1995 | Nenniger | E21B 36/04 166/302 |
| 6,143,988 | A | 11/2000 | Neuroth et al. | |
| 6,167,915 | B1 | 1/2001 | Collie et al. | |
| 6,250,393 | B1 * | 6/2001 | Mackenzie | E21B 23/14 166/242.7 |
| 6,298,921 | B1 * | 10/2001 | Kobylinski | E21B 17/028 166/380 |
| 6,352,113 | B1 | 5/2002 | Neuroth | |
| 6,545,221 | B1 * | 4/2003 | Halpert | E21B 17/028 166/65.1 |
| 7,849,928 | B2 | 12/2010 | Collie | |
| 8,272,448 | B2 | 9/2012 | MacK | |
| 2010/0326694 | A1 | 12/2010 | Pesek et al. | |

FOREIGN PATENT DOCUMENTS

| | | | |
|---|---|---|---|
| WO | 99/51851 | A1 | 10/1999 |
| WO | 2007/034242 | A1 | 3/2007 |

* cited by examiner

METHOD AND APPARATUS FOR SUPPORTING CABLES WITHIN COIL TUBING

FIELD

This relates to a method and apparatus for supporting cables within coiled tubing.

BACKGROUND

Coiled tubing has become a more common element for use in downhole operations, and may be used to house cables, such as, supply lines, capillary tubing, and the like, U.S. Pat. No. 6,352,113 (Neuroth), entitled "Method and apparatus to remove coiled tubing deployed equipment in high sand applications" and U.S. Pat. No. 6,143,988 (Neuroth et al.), entitled "Coiled tubing supported electrical cable having indentations" each describe different supports used to support a cable within the coiled tubing.

SUMMARY

According to an aspect, there is provided a method of hanging a cable within a coiled tubing string. The cable has a first end and a second end. The method comprises the steps of providing a coiled tubing string having a length required within a well having a wellhead, the coiled tubing having a wellhead attachment section and a downhole end spaced from the wellhead attachment section; determining a length of a cable required within the coiled tubing string, the cable comprising an elongate structural component that extends along the length of the cable, the structural component being sufficient to independently support the weight of the cable; cutting the coiled tubing string into first and second sections and installing a hanger sub in the coiled tubing string between the first and second sections toward the wellhead attachment section relative to the downhole end, the hanger sub comprising an inner shoulder that extends radially into the hanger sub and defines an opening; attaching an outer shoulder to the elongate structural component of the cable and inserting the cable into the coiled tubing string until the outer shoulder engages the inner shoulder of the hanger sub such that the cable is hanging within the coiled tubing string below the inner shoulder; and installing the coiled tubing string in a wellhead such that the wellhead attachment section is adjacent to the wellhead and the hanger sub is below the wellhead.

According to another aspect, the hanger sub may be attached to the coiled tubing such that the outer profile is in line with the outer profile of the coiled tubing According to another aspect, the cable may comprise a supply line.

According to another aspect, the method may further comprise the step of attaching the second end of the cable to a downhole tool. The downhole tool may be an electric submersible pump.

According to another aspect, the structural component may comprise a metal capillary tube.

According to another aspect, the cable may comprise a bundle of supply lines. The hanger sub may comprise two or more apertures, at least one aperture comprising the inner shoulder that engages the elongate structural component, at least a portion of the bundle of supply lines passing through a separate aperture, the elongate structural component structurally engaging the supply lines below the hanger sub. The elongate structural component may comprise a metal capillary tube in the bundle of supply lines.

According to another aspect, the cable may comprise a resistive heating element.

According to another aspect, the hanger sub in the coiled tubing string may be between 1 and 50 meters below the wellhead when installed, or between 5 m and 25 m below the wellhead when installed.

According to another aspect, the hanger sub in the coiled tubing string may be positioned below the wellhead end of the coiled tubing string at a depth of between 1% and 5% of the wellbore depth.

According to another aspect, at least one of the shoulder of the hanger sub and the shoulder on the cable may be slotted to prevent rotation of the cable.

According to another aspect, the weight of the cable may be supported solely by the hanger sub.

According to an aspect, there may be provided, in combination, a cable and a length of coiled tubing string. The cable has a first end and a second end and comprises a structural component along the length of the cable. The structural component is sufficient to support the weight of the cable. The length of coiled tubing string has a wellhead end and a downhole end. The coiled tubing string has a first section and a second section connected by a hanger sub. The hanger sub comprises an inner shoulder that extends radially into the hanger sub and defines an opening. The cable has an outer shoulder capable of engaging the inner shoulder of the hanger sub, such that, when installed through a wellhead, the hanger sub is positioned below the wellhead.

According to another aspect, the outer profile of the hanger sub may be in line with the outer profile of the coiled tubing According to another aspect, the cable may comprise a supply line.

According to another aspect, the second end of the cable may have a downhole tool attached. The downhole tool may be an electric submersible pump.

According to another aspect, the structural component may comprise a metal capillary tube.

According to another aspect, the cable may comprise a bundle of supply lines. The hanger sub may comprises two or more apertures, at least one aperture comprising the inner shoulder that engages the elongate structural component, at least a portion of the bundle of supply lines passing through a separate aperture, the elongate structural component structurally engaging the supply lines below the hanger sub. At least one supply line may comprise a metal capillary tube, the metal capillary tube providing structural support to the supply lines.

According to another aspect, the cable may comprise a resistive heating element.

According to another aspect, the hanger sub may be installed, at a distance of between 1 and 50 meters from the wellhead end, or at a distance of between 5 and 25 m from the wellhead end.

According to another aspect, the hanger sub in the coiled tubing string may be positioned below the wellhead end of the coiled tubing string at a depth of between 1% and 5% of the well bore depth.

According to another aspect, at least one of the shoulder of the hanger sub and the shoulder on the cable may be slotted to prevent rotation of the cable.

According to another aspect, the weight of the cable may be supported solely by the hanger sub when installed in the wellhead.

BRIEF DESCRIPTION OF THE DRAWINGS

These and other features will become more apparent from the following description in which reference is made to the appended drawings, the drawings are for the purpose of illustration only and are not intended to be in any way limiting, wherein.

DETAILED DESCRIPTION

An apparatus and method of positioning a cable within a coiled tubing string will be described with reference to FIGS. 1-6 in the context of an electric submersible pump in a well with a positive well head pressure. It will be understood that the support described below may also be used in other situations as well.

Figure 5:
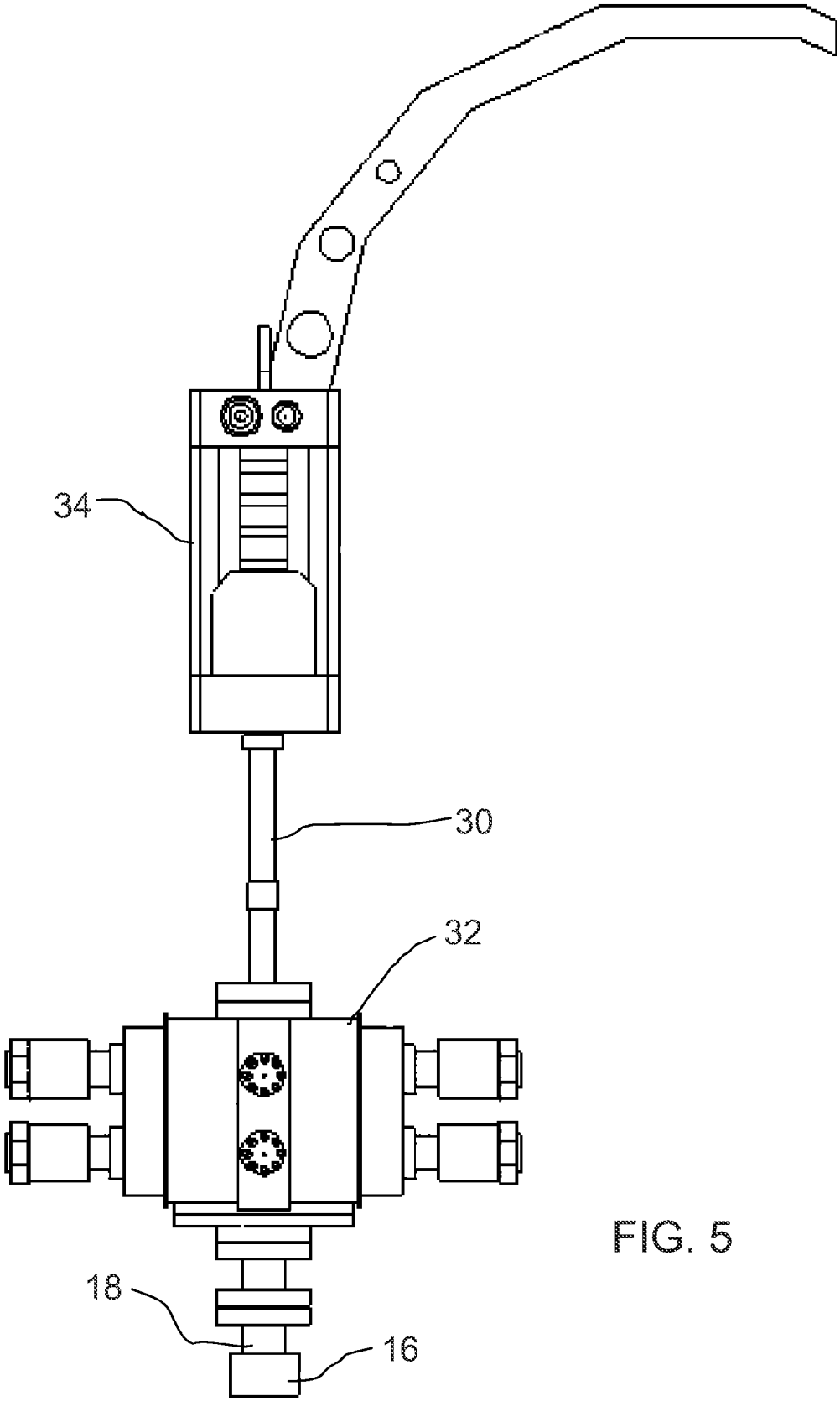
FIG. 5 is a side elevation view of an apparatus for servicing an electric submersible pump.
Figure 6:
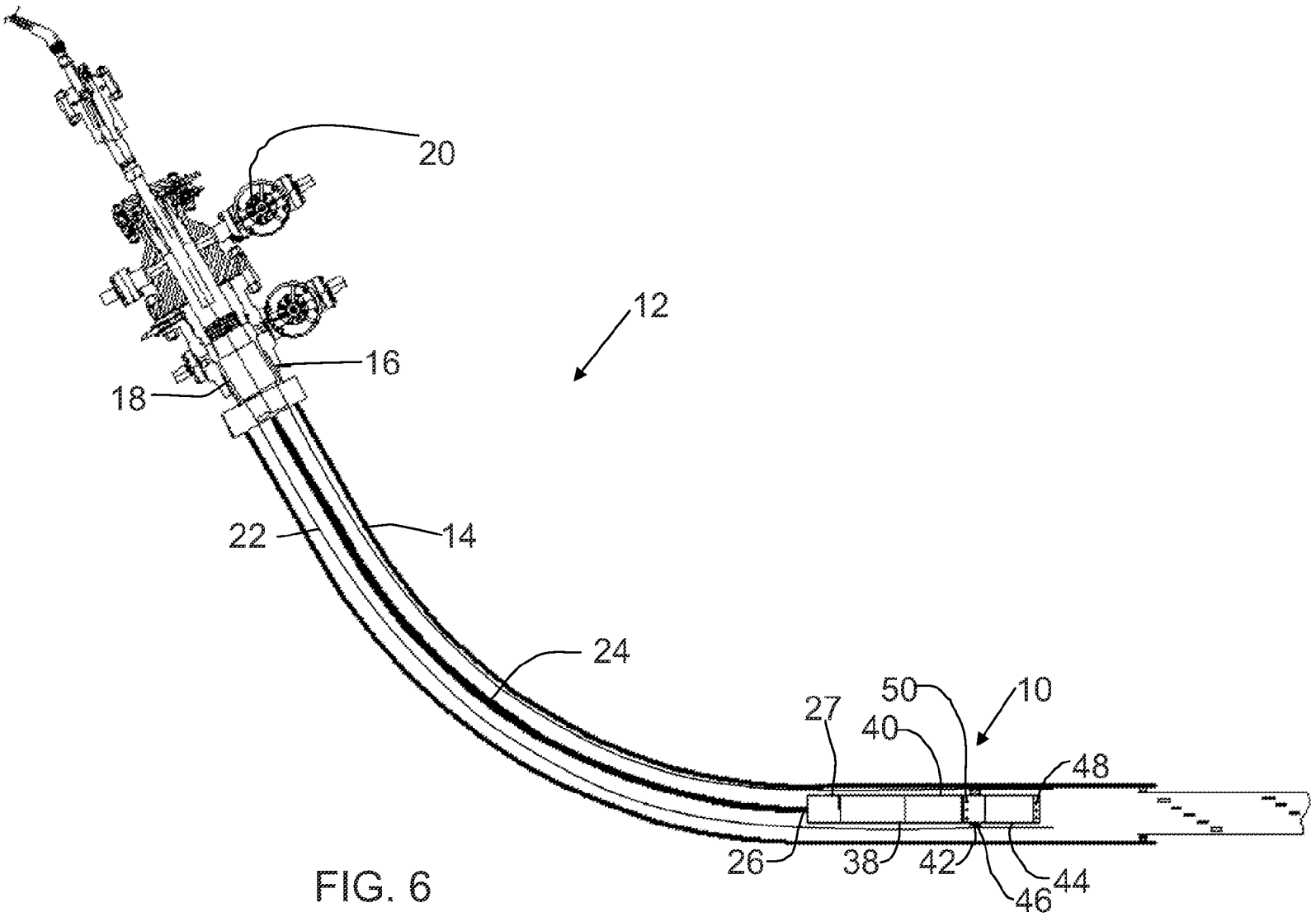
FIG. 6 is a side elevation view of a well completion with an electric submersible pump connected to surface by a coiled tubing string and elongate supply lines within the coiled tubing string.

Referring to FIG. 6, well 12, which may be a pressurized well, includes a casing 14 and a wellhead 16 mounted to casing 14. Wellhead 16 has a sealable injection port 18, and production ports 20. Referring to FIG. 5, injection port 18 may be sealed by a blow out preventer (BOP) 32 as shown, or it may also be sealed by a valve, a plug, etc., which may be above or below the actual port 18. Referring again to FIG. 6, the number of production ports 20 may vary depending upon the design of wellhead 16. Production tubing 22 is positioned in casing 14 and is connected to wellhead 16. Production fluids that are pumped upward by electric submersible pump 10 flow through production tubing 22 and out production ports 20 of wellhead 16. Electric submersible pump 10 is carried by a coded tubing string 24 at a downhole end 26 of coiled tubing string 24, and is sized such that it is able to be run through production tubing 22. Cables, which may include a metal capillary tube 28 and other supply lines 29 as shown, are run through and enclosed within coiled tubing string 24 and connect to electric submersible pump 10. Metal capillary tube 28 is preferably used to supply oil, while other supply lines 29 may be used for power, communication lines, control lines, instrumentation lines, resistive heating elements, and the like. The choice of cable may be such that the cable is structurally self-supporting. Alternatively, metal capillary tube 28 provides structural support to supply lines 29. A pump-receiving housing 30, shown in FIG. 5, is located above injection port 18 of wellhead 16. The height of pump receiving housing 30 will depend upon the size of electric submersible pump 10. Pump-receiving housing 30 is designed such that is may be sealed to the atmosphere when injection port 18 is open, and openable to the atmosphere when injection port 18 is sealed. In other words, housing 30 works with injection port 18 to ensure that well 12 is always sealed when it is pressurized. Referring to FIG. 5, a BOP 32 is located above wellhead 16 and below pump-receiving housing 30. Coiled tubing injector 34 is located above pump-receiving housing 30 and, referring to FIG. 6, is used to control the position of coiled tubing string 24 and electric submersible pump 10 in well 12.

Figure 1:
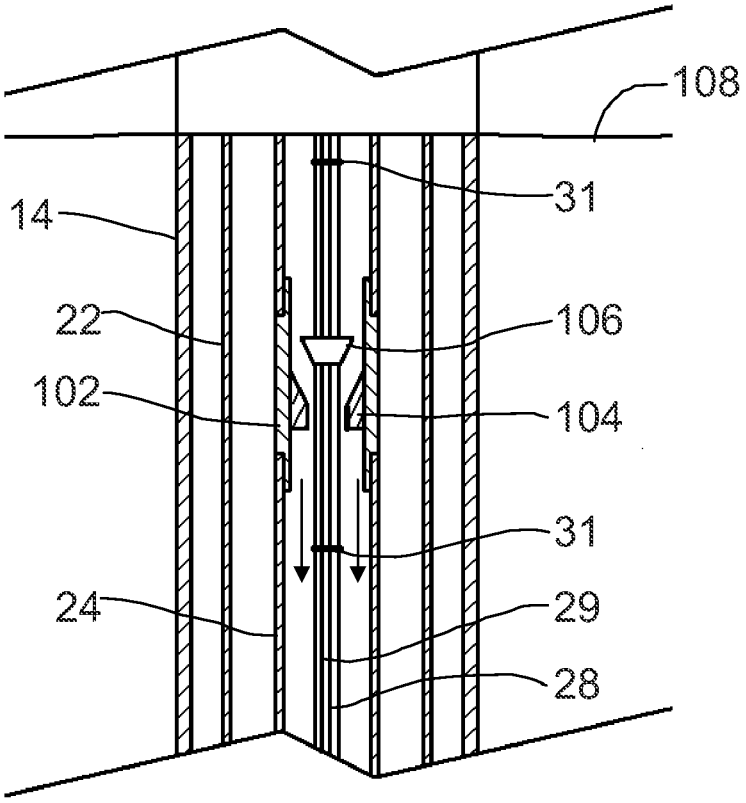
FIG. 1 is a side elevation view in section of a supply line hanging in a coiled tubing string.

Referring to FIG. 1, metal capillary tube 28 provides structural support to supply lines 29. As shown, this is done by attaching supply lines 29 to capillary tube 28 using clamps 31, although it may also be done in other ways. For example, supply lines 29 and capillary tube 28 may be encapsulated together. Furthermore, supply lines 29 and capillary tube 28 may be any self-supporting cable that acts as a structural component and that may be used in downhole applications.

As shown, supply lines 29 generally require structural support as the lengths of tube 28 and lines 29 may be long enough to overcome the inherent strength of lines 29 and stretch or break. Once supply lines 29 are supported by capillary tube 28 they become self-supporting. Capillary tube 28 and supply lines 29 are mounted within and supported by coiled tubing string 24. This is done by providing coiled tubing string 24 with a hanger sub 102 that has a shoulder 104 that engages a corresponding shoulder 106 carried by capillary tube 28. Hanger sub 102 is preferably close to surface 108, such as between 1 meter and 50 meters below surface, such that the majority of the length of capillary tube 28 is below hanger sub 102 and coiled tubing string 24 and there will not be movement at the surface where there is required an anchor point. Alternatively, capillary tube 28 may be mounted at a position that is based on a percentage of the depth of the wellbore, such as between 1% and 5%, Hanger sub 102 is preferably a single body but may be a two-piece that can be placed around supply lines 29. As shown, the hanger sub shoulder is integrally formed with the hanger sub. The hanger sub is welded or otherwise attached to the coiled tubing such that the outer profile is in line with the outer profile of the coiled tubing. This ensures that the coiled tubing does not have an external upset or any increased outer diameter, which allows for ease of transport and installation. The hanger sub is attached by welding or another method in such a way that it does not substantially degrade the mechanical properties of the coiled tubing and has properties that are within the specifications for the coiled tubing string as a whole. This is particularly useful in thermal applications. Where the properties including resistance to corrosion are maintained within the specifications required for the coiled tubing.

Figure 2:
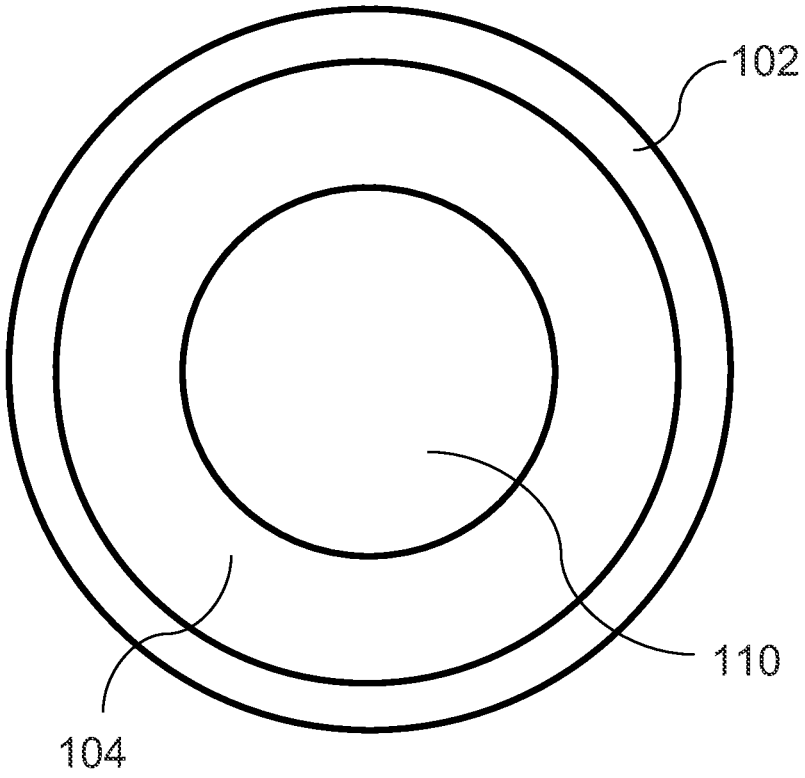
FIG. 2 is a top view of a hanger sub.
Figure 4:
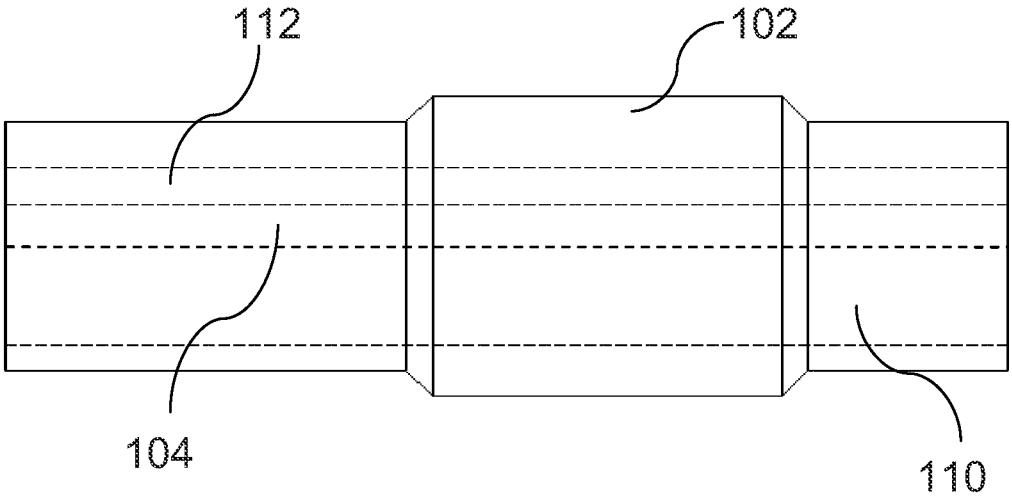
FIG. 4 is a side elevation view of a hanger sub.

Referring to FIGS. 2 and 4, hanger sub 102 has an opening 110 through which the cable will pass. The shoulder 106 attached to the cable will engage hanger sub shoulder 104, positioning the cable within the hanger sub 102.

Figure 3:
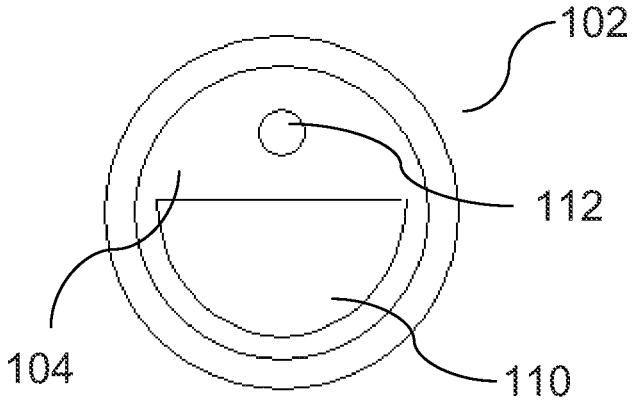
FIG. 3 is a top view of a hanger sub in a particular embodiment.

Referring to FIG. 3, in a particular embodiment, hanger sub shoulder 104 may have an additional opening 112 that provides a passage for an additional support cable if needed. In this embodiment the cable may have a support line such as a capillary support tube, metal wire, or rod, attached to the cable to provide structural support below the hanger sub. The support line may carry the shoulder 106 which is positioned above opening 112, shoulder 106 engaging with hanger sub shoulder 104 at opening 112.

Referring to FIG. 4, hanger sub 102 is shown from a side elevation.

The description above assumes a situation where both power or communication and fluid supply are connected to a downhole tool. However, this may change depending on the circumstances. For example, rather than a bundle of supply lines 28 and 29, in some circumstances there may only be a metal capillary tube 28, or more than one capillary tube 28. In other circumstances, there may not be a capillary tube 28. While a metal capillary tube 28 is useful for providing structural support, other structural members may also be provided if fluid is not required downhole, such as a metal wire or rod that are less expensive than capillary tube 28.

When one hanger sub 102 is provided, capillary tube 28 may be run in to coiled tubing string 24 without any other hindrance, and will be properly positioned once it is correctly inserted without taking any additional steps in the process. By knowing the length of coiled tubing string 24 and the length of capillary tube 28, hanger sub 102 and outer shoulder 106 may be installed to have each end at the correct position, such as to attached to an electric submersible pump 10 as shown in FIG. 6, or any other downhole tool that may be run on a coiled tubing string.

The above structure may be used when installing or removing an electric submersible pump 10 without having to cool well 12. In the depicted example, in order to insert electric submersible pump 10 into a well with a positive well head pressure, injection port 18 is first sealed by closing BOP 32. Pump-receiving housing 30 contains electric submersible pump (ESP) 10, which is then connected to coiled tubing string 24. Pump receiving housing 30 is then mounted to the BOP 32. Pump-receiving housing 30 is then closed and sealed to atmosphere and BOP 32 is opened to allow electric submersible pump 10 to be inserted through injection port 18 in wellhead 16 and into well 12 by operating coiled tubing injector 34. In order to remove electric submersible pump 10 from pressurized well 10, the process is reversed, with coiled tubing injector 34 lifting electric submersible pump 10 through wellhead 16 and into housing 30. BOP 32 is then closed and sealed, and housing 30 is either opened or removed from BOP 32 to provide access to electric submersible pump 10. Electric submersible pump 10 may then be serviced or replaced, as necessary.

As depicted, electric submersible pump 10 is preferably an inverted electric submersible pump, and is run off a 1¼"-3½" coiled tubing string 24 that contains the instrumentation lines. Other sizes may also be used, depending on the preferences of the user and the requirements of the well. When compared with traditional electric submersible pumps, electric submersible pump 10 lacks the seal section, motor pothead and wellhead feedthrough. As shown, electric submersible pump 10 includes a power head 27, motor section 38, thrust chamber 40, one or more seal rings 42 and electric submersible pump section 44. Thrust chamber 40 includes two mechanical seals with a check valve (not shown), and replaces the conventional seal/protector section that separates pump section 44 and motor section 38. The check valve in thrust chamber 40 allows the lubricating fluid supplied by capillary tube 28 to exit thrust chamber 40 and comingle with, for example, produced fluids from the well with the pump discharge from outlet ports 50. Seal rings 42 seal against a pressure sealing seat 46 that is carried by production tubing 22, to provide seal between inlet ports 48 and outlet ports 50. Inlet ports 48 are in communication with downhole fluids to be pumped to surface via outlet ports 50, which are positioned within production tubing 22.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

The following claims are to be understood to include what is specifically illustrated and described, above, what is conceptually equivalent, and what can be obviously substituted. Those skilled in the art will appreciate that various adaptations and modifications of the described embodiments can be configured without departing from the scope of the claims. The illustrated embodiments have been set forth only as examples and should not be taken as limiting the invention. It is to be understood that, within the scope of the following claims, the invention may be practiced other than as specifically illustrated and described.

What is claimed is:

1. A method of hanging a cable within a coiled tubing string, the cable having a first end and a second end, the method comprising the steps of:

providing a coiled tubing string having a length required within a well having a wellhead, the coiled tubing string having a wellhead attachment section and a downhole end spaced from the wellhead attachment section;

determining a length of a cable required within the coiled tubing string, the cable comprising an elongate structural component that extends along the length of the cable, the structural component being sufficient to independently support the weight of the cable;

cutting the coiled tubing string into first and second sections and installing a hanger sub in the coiled tubing string between the first and second sections toward the wellhead attachment section relative to the downhole end, the hanger sub comprising an inner shoulder that extends radially into the hanger sub and defines an opening;

attaching an outer shoulder to the elongate structural component of the cable and inserting the cable into the coiled tubing string until the outer shoulder engages the inner shoulder of the hanger sub such that the cable is hanging within the coiled tubing string below the inner shoulder;

installing the coiled tubing string in the wellhead such that the wellhead attachment section is adjacent to the wellhead and the hanger sub is below the wellhead.

2. The method of claim 1, wherein the hanger sub is attached to the coiled tubing string such that the outer profile is in line with the outer profile of the coiled tubing string.

3. The method of claim 1, wherein the cable comprises a supply line.

4. The method of claim 1, further comprising the step of attaching the second end of the cable to a downhole tool.

5. The method of claim 4, wherein the downhole tool is an electric submersible pump.

6. The method of claim 1, wherein the structural component comprises a metal capillary tube.

7. The method of claim 1, wherein the cable comprises a bundle of supply lines.

8. The method of claim 7, wherein the hanger sub comprises two or more apertures, at least one aperture comprising the inner shoulder that engages the elongate structural component, at least a portion of the bundle of supply lines passing through a separate aperture, the elongate structural component structurally engaging the supply lines below the hanger sub.

9. The method of claim 7, wherein the elongate structural component comprises a metal capillary tube in the bundle of supply lines.

10. The method of claim 1, wherein the cable comprises a resistive heating element.

11. The method of claim 1, wherein the hanger sub in the coiled tubing string is between 1 and 50 meters below the wellhead when installed.

12. The method of claim 1, wherein the hanger sub in the coiled tubing string is between 5 and 25 meters below the wellhead when installed.

13. The method of claim 1, wherein the hanger sub in the coiled tubing string is positioned below a wellhead end of the coiled tubing string at a depth of between 1% and 5% of the wellbore depth.

14. The method of claim 1, wherein at least one of the shoulder of the hanger sub and the shoulder on the cable are slotted to prevent rotation of the cable.

15. The method of claim 1, wherein the weight of the cable is supported solely by the hanger sub.

* * * * *